United States Patent [19]

Wendt

[11] 3,964,214

[45] June 22, 1976

[54] SMOKE STOP

[75] Inventor: Alan C. Wendt, Barrington, Ill.

[73] Assignee: United States Gypsum Company, Chicago, Ill.

[22] Filed: June 25, 1975

[21] Appl. No.: 590,247

[52] U.S. Cl. ..... 52/1; 52/204; 52/232; 49/504

[51] Int. Cl.² ..... E04H 9/00

[58] Field of Search ..... 52/1, 317, 232, 204; 49/488, 504; 220/88 R, 88 A

[56] References Cited

UNITED STATES PATENTS

| | | | |
|---|---|---|---|
| 3,426,491 | 2/1969 | Gaeth et al. | 52/232 |
| 3,566,541 | 3/1971 | Coulter | 49/475 |

*Primary Examiner*—Frank L. Abbott
*Assistant Examiner*—Carl D. Friedman
*Attorney, Agent, or Firm*—Donnie Rudd; Samuel Kurlandsky; Kenneth E. Roberts

[57] ABSTRACT

A smoke stop for doors is disclosed. The smoke stop comprises a metal frame with a slot therein extending substantially the entire length of the frame on the door side thereof; a movable lid pivotally attached along one outer edge of the metal frame and releasably attached to a second outer edge of the metal frame thereby completely enclosing the slot in the metal frame; and an intumescent material completely enclosed within the enclosed slot. When the door is closed and the frame and door are subjected to flames, the intumescent material expands causing the sealing of the space between the frame and the door and thereby providing a smoke stop between the door and the frame.

7 Claims, 3 Drawing Figures

SMOKE STOP

BACKGROUND OF THE INVENTION

1. Field of the Invention

This invention relates to a smoke stop for doors.

2. Description of the Prior Art

It has long been a desire of the construction industry to provide a smoke stop between a closed door and the frame supporting the door. This smoke stop provides numerous advantages. If the smoke stop is effective as a smoke stop, it prevents smoke from passing through the door passage when a fire exists on one side of the door. This feature is extremely important from a health and safety standpoint. An additional advantage of a smoke stop is that it prevents passage of air into the room containing a flame thereby slowing the rate of spread of the flame.

Many attempts have been made to prepare a smoke stop for doors. The first such attempts made use of sealing materials between the frame and the door whereupon closing of the door deformed the seal and at all times closed the gap between the door and the frame. The disadvantage of this type of construction is that at all times the resilient material must contact the closed door, and the opening and closing of the door is thereby impeded. Additionally, wear on the door is caused by the consequent relative frictional movement upon opening and closing the door. If the edge of the door is a decorative surface, i.e., a highly finished painted or varnished section, then the constant contacting with the resilient material upon opening and closing of the door debases this highly decorative surface making it unsightly when the door remains open.

The use of intumescent materials to seal the space between a door and a frame is not novel. Many attempts have been made to utilize intumescent materials, i.e., materials that expand upon application of heat, to overcome the problems associated with the usage of the resilient facings and yet to provide an effective seal between the frame and the door upon contact thereof with a flame. These prior attempts, however, have all fallen short of the intended goal for one or more reasons. The basic failure of the systems has been due to the fact that most of the systems use an exposed intumescent material which upon sufficient heating melts and runs down the door thereby relinquishing its sealing properties. Other systems provide sealing with a combustible material which soons burns away and provides only a temporary solution before again presenting the problem of the material melting and destroying the seal. Still other systems have utilized slots within the frame with the slots containing an exposed intumescent material which upon heating expands and extrudes out of the slots into the space between the door and the frame. This system, however, fails for the same reasons mentioned above, namely, that the material soon melts and the seal becomes inoperative.

Prior issued patents demonstrate that the above-discussed systems have the shortcomings explained with relation thereto. In U.S. Pat. No. 3,774,345, a good example of the resilient contacting-type design is shown. This constant contact and rubbing with the door, however, tends to deface the door and thereby makes this type of system undesirable. Norwegian Pat. No. 66,400 is an early example of an intumescent simply laid upon the door frame itself for expansion upon heating. This system, however, has the consequent shortcomings of the material melting and then not providing an adequate seal between the door and the frame. Likewise, British Pat. No. 896,149 provides a similar system with an intumescent material on the face of the frame, however; one embodiment of this patent does provide an additional support for the intumescent material which prevents expansion in one direction. This system, however, does have the shortcoming of the intumescent material's being able to melt and run out of the sealing area thereby causing a failure of the smoke stop system. British Pat. No. 896,150, provides still another system of placing an intumescent material within a slot in the frame, but this system merely directs the channeling of the intumescent material in a different direction and does not overcome the hereinabove discussed associated problems. Norwegian Pat. No. 104,072, is a system almost identical to the last mentioned British Patent but enclosing the intumescent material in a rapidly decomposable tube which soon burns away thus leading to the same problems discussed in relation to the above-mentioned designs. U.S. Pat. No. 2,910,739, makes use of intumescent materials placed in a slot in the door, but, at best, the improvement therein is one in which wood encloses a portion of the intumescent material causing the obvious problem of the wood's rapidly burning away thereby exposing the intumescent material to flame which readily destroys it and the seal provided thereby. Danish Pat. No. 93,373, provides for an enclosed material, but the intumescent material can only expand through slots in the frame, and after extruding through the slots, the material again creates the problems discussed hereinbefore. U.S. Pat. No. 3,566,541, makes good use of a combination of the prior art systems providing for one exposed strip of intumescent material which has the problems discussed hereinbefore, but which also provides for an enclosed intumescent material sealed within a resilient contacting sealer. This design not only creates permanent contact and frictional wear on the door due to the continuous contact upon closing of the door, but as well, has the problems associated with a decomposable container for the intumescent material which, upon burning, provides the same problems discussed hereinbefore. Likewise, Danish Pat. No. 92,422, provides an intumescent material completely enclosed by a combustible material which upon burning of the combustible material provides the same problems discussed hereinbefore. Finally, U.S. Pat. No. 3,426,491, makes good use of a sandwich-type system for sandwiching the intumescent material between metal and wood, but again, this system fails to prevent ready escape of the intumescent material creating the consequent failure of the seal upon heating. In this invention, intumscent material is enclosed within a slot which has a pivotable lid thereon, and the expansion of the intumescent material presses the pivotable lid against the door, making a sealing contact with the door to prevent smoke from passing into the passage therebetween. In this instance, while the intumescent material may then melt and run out of the slot, it has served its function by forcing the metal plate into a sealing relationship between the frame and the door, and since the metal plate is made of a noncombustible material, the seal remains intact so long as the remaining portions of the door and frame are not destroyed by the heat of the flame itself. It may thus be seen that the new and novel designs of this invention readily overcome the failing features associated with prior systems.

SUMMARY OF THE INVENTION

It is an object of this invention to provide a smoke stop for doors.

It is a further object of this invention to provide a smoke stop for doors which will not fail at the kindling temperature of a wood door.

It is an additional object of this invention to provide a combination door and frame which provides for a smoke stop therebetween upon heating of the door and the frame due to flame exposure.

It is an additional object of this invention to provide an assembled wall with a door and frame therein having a smoke stop provided in the door frame for sealing the space between the door and the frame when the wall is subjected to flames.

It is a further object of this invention to provide a method for making a door frame which upon subjection to flames provides a smoke stop between the frame and a door closed therein.

The objects of this invention are accomplished by a smoke stop for door comprising: a metal frame with a slot therein extending along substantially the entire length of the frame on the door side thereof; a movable lid pivotably attached along one outer edge of the metal frame and releasably attached to a second outer edge of the metal frame thereby completely enclosing the slot in the metal frame; and an intumescent material completely enclosed within the enclosed slot, whereby when the door is closed and the frame is subjected to flames the intumescent material expands causing the movable lid to release along one edge thereof and pivot about the other edge thereof to enter into contact engagement with the door along an edge thereof thereby providing a smoke stop between the door and the frame.

Of particular importance in the above-described smoke stop, the movable lid is releasably attached to the second outer edge of the metal frame by an adhesive placed therebetween. In another embodiment, the movable lid is releasably attached to the second outer edge of the metal frame by a mechanically releasable fastener.

The objects of this invention are also accomplished by the combination comprising a door and a metal frame for holding the door, said metal frame having a slot therein extending along substantially the entire length of the frame on the door side thereof; a movable lid pivotably attached along one outer edge of the metal frame and releasably attached to a second outer edge of the metal frame thereby completely enclosing the slot in the metal frame; and an intumescent material completely enclosed within the enclosed slot, whereby when the door is closed and the frame is subjected to flames, the intumescent material expands causing the lid to release along the releasably attached portion thereof and pivot about the other edge thereof to enter into contact engagement with the door and form a smoke stop between the door and the frame.

The objects of this invention are additionally accomplished by the combination comprising an assembled wall with an opening therein, a metal door frame in the opening, and a door attached to the frame, said frame having a slot therein extending along substantially the entire length of the frame on the door side thereof; a movable lid pivotally attached along one outer edge of the metal frame and releasably attached to a second outer edge of the metal frame thereby completely enclosing the slot in the metal frame; and an intumescent material completely enclosed within the enclosed slot, whereby when the door is closed and the frame is subjected to flames, the intumescent material expands causing the releasably attached portion of the lid to release and the lid to pivot about the other edge thereof thereby entering into contact engagement with the door and thereby providing a smoke stop between the door and the frame.

The objects of this invention are still further accomplished in a door frame having an intumescent material disposed along the door side of the frame with said intumescent material expanding upon subjection of the frame to flames and with said expansion causing a seal between the frame and the door to prevent passage of smoke therebetween, by the improvement comprising: a metal door frame having a slot therein extending along substantially the entire length of the frame on the door side thereof; a movable lid pivotally attached along one outer edge of the metal frame and releasably attached to a second outer edge of the metal frame thereby completely enclosing the slot in the metal frame; and an intumescent material completely enclosed within the enclosed slot, whereby when the frame is subjected to flames the intumescent material expands causing the releasably attached portion of the lid to release and the lid to pivot about the other edge thereof thereby entering into contact engagement with the door to provide a smoke stop between the door and the frame.

The objects of this invention are additionally accomplished by a method of making a door frame which when subjected to flames acts in conjunction with a door to provide a smoke barrier, said method comprising: preparing a door frame with a slot extending along substantially the entire length thereof; inserting within the slot a layer of intumescent material, pivotally attaching a lid along one edge of the slot and closing the lid and sealing it along the other edge of the slot.

In this invention, the smoke stop makes use of a movable lid pivotally attached along one outer edge of the metal frame and releasably attached to a second outer edge of the metal frame thereby completely enclosing a slot in the metal frame. The intumescent material is completely enclosed within the enclosed slot. When the door is closed and the frame is subjected by flames, the intumescent material expands causing the movable lid to release along one edge thereof and pivot about the other edge thereof to enter into contact engagement with the door along an edge thereof, thereby providing a smoke stop between the door and the frame. At that point, while the intumescent material may be exposed to heat, thus suffering the disadvantages of prior systems, the movable lid has then engaged the door and provided a seal between the door and the frame thereby preventing smoke from passing through the space between the door and the frame regardless of the disposition of the intumescent material.

BRIEF DESCRIPTION OF THE DRAWINGS

This invention may be more fully described, but is not limited by the attached drawings wherein.

DESCRIPTION OF THE PREFERRED EMBODIMENTS

Figure 1:
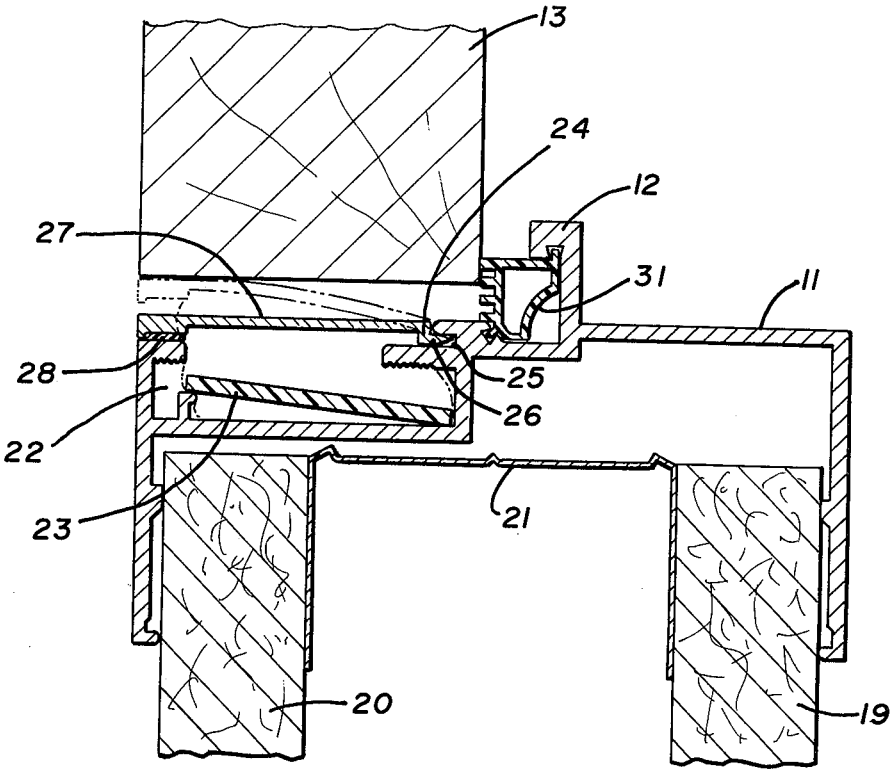
FIG. 1 is a top cross-sectional view of the smoke stop of this invention in place with a wall and door shown.
Figure 2:
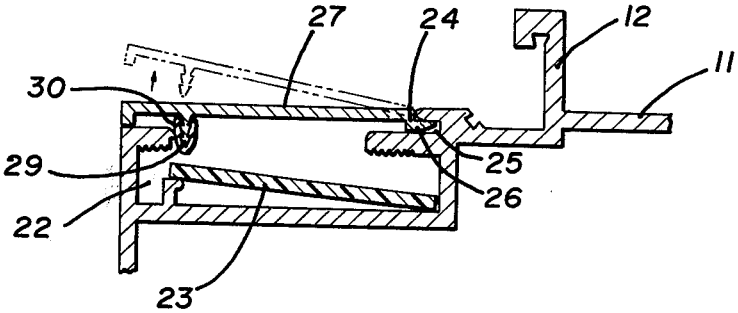
FIG. 2 is a top cross-sectional view of another embodiment of the smoke stop of this invention using mechanical fastening means.
Figure 3:
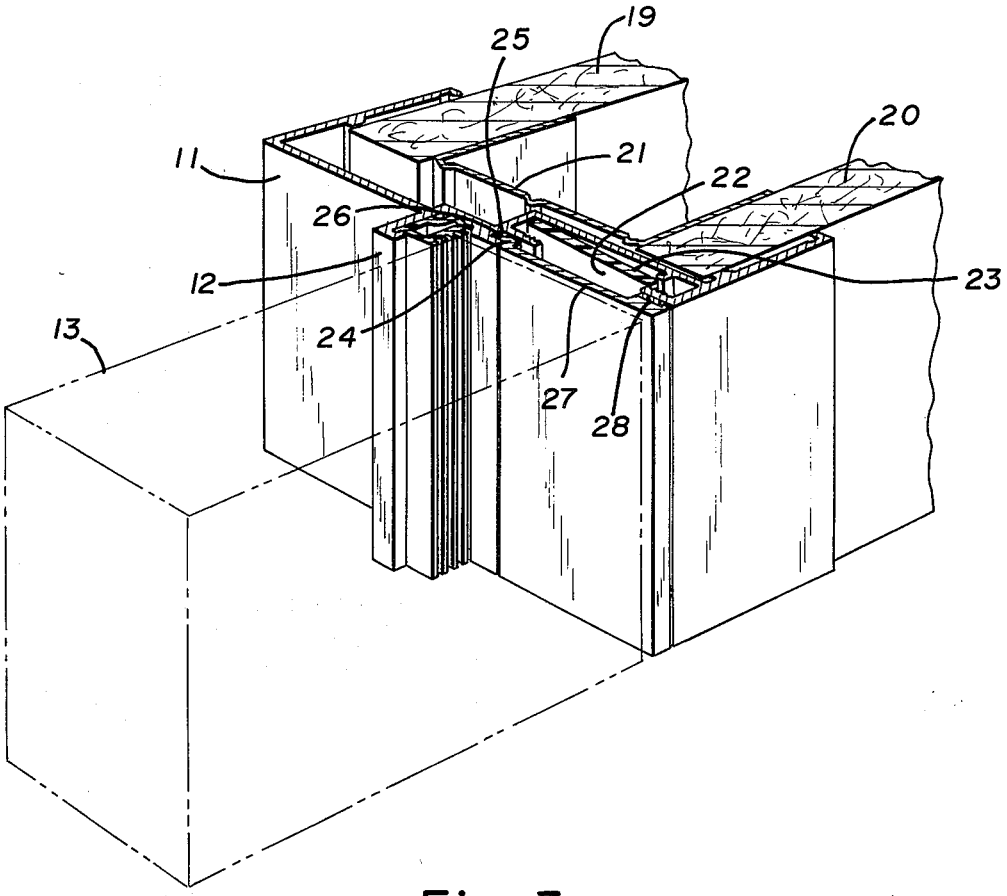
FIG. 3 is a cross-sectional perspective view of another embodiment of the smoke stop of FIG. 1.

The preferred embodiments of this invention are more fully described by the attached drawings. In FIGS. 1–3, a door frame 11 has a door stop 12 extending outward therefrom to stop movement of the door 13 at the desired location. Although, any wall system is acceptable for use in this invention, the preferred embodiments include a particularly desirable type of system wherein the door frame engages wall panels 19 and 20 which are additionally secured by stud 21. The slot 22 in the frame has intumescent material 23 disposed therein.

The intumescent material may be that used in any of the previously described systems as well as such material as is described in U.S. Pat. Nos. 2,912,393, 2,632,743, and 3,365,322 and includes additionally such materials as aluminum chloride added to incompletely condensed phenol-formaldehyde condensates; ammonium salts, along with dextrin or urea, with a filler, ammonium phosphate, sugar, gum arabic and further including other additives well known to the intumescent art such as water, glass fibers, alkali metal silicate and the many other systems known as intumescent material, and other such systems which have the property of being readily expandable upon heat to the extent that they force outward the fins on the tube so that they will contact the door to provide a smoke stop between the door and frame. In other words, any of the well known intumescent material are acceptable providing that upon application of the heat range of normal flame temperatures within a room, they readily expand to force the fins outward in contact with the door. It has been found to be particularly acceptable to use various plastic materials which have entrained or entrapped therein small particles of water and which upon heat expand forcing the plastic itself to expand and force outward the fins to the extent necessary to contact the door.

On one edge of the outside of the frame adjacent to the door, a pivotable attachment 24 formed, in this embodiment, as a slot 25 with offset 26 of lid 27 pivotably engaged therein. On the other end of the slot, at an edge of the frame adjacent to the door, is means for attaching the pivotable lid to the frame. In FIGS. 1 and 3 this means is shown as a double-faced adhesive tape or the like 28, although any adhesive is acceptable so long as the adhesive will release the lid upon pressure from the expanding intumescent material but taking into account the additional consideration that the adhesive will not release the pivotable release portion of the frame in normal operation of the door within the frame. In FIG. 2, a mechanical attachment is shown wherein barbed inserts 29 engage resilient material 30, with the resilient material being capable of releasing the barbed inserts upon expansion of the intumescent material within the closed chamber. In all such embodiments, the intumescent material is completely enclosed within the slot.

Additional design features of the doors may be those readily recognized within the industry and provide cushioning stops or the like, such as cushion 31, although these need not be necessarily incorporated within the scope of this invention to provide an adequate smoke stop between the door and the frame.

Within the operation of the smoke stop of this invention, the expansion of the intumescent material forces the release mechanism on one edge of the lid to release the lid and the lid to pivot about the other end thereof until it contacts the door. At this time, the intumescent material may be additionally heated until it escapes from the channel, but the lid, being constructed out of a non-combustible material, will effectively provide a permanent smoke stop between the door and the frame until such time as other portions of the entire system fail due to combustion.

It may be seen that this new and novel invention provides a new and unique system which has heretofore been unknown. The system readily and inexpensively overcomes all of the deficiencies of prior systems and provides an effective smoke stop between a door and a frame upon exposure of the door and the frame to the heat of a flame. This new and novel design provides heretofore unknown safety features and significantly advances construction systems which provide for smoke stops between doors and door frames.

Having fully described this new and unique invention, the following is claimed:

1. A smoke stop for doors comprising: a metal frame with a slot therein extending along substantially the entire length of the frame on the door side thereof; a movable lid pivotably attached along one outer edge of the metal frame and releasably attached to a second outer edge of the metal frame thereby completely enclosing the slot in the metal frame; and an intumescent material completely enclosed within the enclosed slot, whereby when the door is closed and the frame is subjected to flames the intumescent material expands causing the movable lid to release along one edge thereof and pivot about the other edge thereof to enter into contact engagement with the door along an edge thereof thereby providing a smoke stop between the door and the frame.

2. A smoke stop as in claim 1 wherein the movable lid is releasably attached to the second outer edge of the metal frame by an adhesive placed therebetween.

3. A smoke stop as in claim 1 wherein the movable lid is releaseably attached to the second outer edge of the metal frame by a mechanically releasable fastener.

4. In combination, a door and a metal frame for holding the door, said metal frame having a slot therein extending along substantially the entire length of the frame on the door side thereof; a movable lid pivotably attached along one outer edge of the metal frame and releasably attached to a second outer edge of the metal frame thereby completely enclosing the slot in the metal frame; and an intumescent material completely enclosed within the enclosed slot, whereby when the door is closed and the frame is subjected to flames, the intumescent material expands causing the lid to release along the releasably attached portion thereof and pivot about the other edge thereof to enter into contact engagement with the door and form a smoke stop between the door and the frame.

5. In combination, an assembled wall with an opening therein, a metal door frame in the opening, and a door attached to the frame, said frame having a slot therein extending along substantially the entire length of the frame on the door side thereof; a movable lid pivotably attached along one outer edge of the metal frame and releasably attached to a second outer edge of the metal frame thereby completely enclosing the slot in the metal frame; and an intumescent material completely enclosed within the enclosed slot, whereby when the door is closed and the frame is subjected to flames the intumescent material expands causing the releasably attached portion of the lid to release and the lid to pivot about the other edge thereof thereby entering into contact engagement with the door and thereby providing a smoke stop between the door and the frame.

6. In a door frame having an intumescent material disposed along the door side of the frame with said intumescent material expanding upon subjection of the frame to flames and with said expansion causing a seal between the frame and the door to prevent passage of smoke therebetween, the improvement comprising: a metal door frame having a slot therein extending along substantially the entire length of the frame on the door side thereof; a movable lid pivotably attached along one outer edge of the metal frame and releasably attached to a second outer edge of the metal frame thereby completely enclosing the slot in the metal frame; and an intumescent material completely enclosed within the enclosed slot, whereby when the frame is subjected to flames the intumescent material expands causing the releasably attached portion of the lid to release and the lid to pivot about the other edge thereof thereby entering into contact engagement with the door to provide a smoke stop between the door and the frame.

7. A method of making a door frame which in contact with flames acts in conjunction with a door to provide a smoke barrier, said method comprising: preparing a door frame with a slot extending along substantially the entire length thereof; inserting within the slot a layer of intumescent material, pivotally attaching a lid along one edge of the slot and closing the lid and sealing it along the other edge of the slot.

* * * * *